United States Patent [19]

Schmidt

[11] Patent Number: 4,827,685

[45] Date of Patent: May 9, 1989

[54] INSULATOR FOR RAIL INTERLOCK AT UPPER/LOWER WINDOW SASH INTERFACE

[75] Inventor: Dietrich F. Schmidt, Etters, Pa.

[73] Assignee: Capitol Products Corporation, Mechanicsburg, Pa.

[21] Appl. No.: 98,221

[22] Filed: Sep. 18, 1987

[51] Int. Cl.[4] ..... E04B 1/74

[52] U.S. Cl. ..... 52/404; 49/DIG. 1; 49/490

[58] Field of Search ..... 52/394, 399, 395, 464, 52/471, 403, 404; 49/DIG. 1, 458, 488, 490

[56] References Cited

U.S. PATENT DOCUMENTS

| | | | |
|---|---|---|---|
| 1,976,766 | 10/1934 | Blessin | 52/403 |
| 2,975,492 | 3/1961 | Persson | 52/403 |
| 2,981,385 | 4/1961 | Osten, Sr. | 49/DIG. 1 |
| 3,055,468 | 9/1962 | Horejs et al. | 49/DIG. 1 |
| 3,381,434 | 5/1968 | Carson | 52/403 |
| 4,015,380 | 4/1977 | Hemminger | 52/395 |
| 4,024,690 | 5/1977 | Collins | 52/403 |
| 4,151,682 | 5/1979 | Schmidt | 49/DIG. 1 |
| 4,344,257 | 8/1982 | Anderson | 52/403 |
| 4,471,584 | 9/1984 | Dietrich | 52/398 |
| 4,619,092 | 10/1986 | Kaminaga | 52/403 |

*Primary Examiner*—David A. Scherbel
*Assistant Examiner*—Caroline D. Dennison
*Attorney, Agent, or Firm*—Edgar E. Spielman, Jr.

[57] ABSTRACT

A modification for window or door assemblies having interlocks on the sash rails where insulating material is placed between the interlock of a lower rail to an upper sash and the interlock of an upper rail to a lower sash so as to act as a thermal barrier against heat conduction through the upper sash which is exposed to exterior climate of the building in which the window or door assembly is being used.

8 Claims, 3 Drawing Sheets

INSULATOR FOR RAIL INTERLOCK AT UPPER/LOWER WINDOW SASH INTERFACE

BACKGROUND OF THE INVENTION

1. Field of the Invention

This invention relates to metal frame window assemblies and more particularly to the lower rail of an upper sash and the upper rail of a lower sash each of which has an interlock channel which overlaps the other interlock channel. Similarly, this invention also relates to metal door assemblies and more particularly to the inner stile of an exterior panel and an inner stile of an interior panel each of which has an interlock channel which overlaps the other interlock channel.

2. Description of the Related Art.

The invention particularly relates to thermally insulated windows or doors and similar panel assemblies for installation in an opening of an enclosed wall exposed to different temperature conditions at the opposite sides thereof.

The relatively high thermal conductivity of metals, such as aluminum or alloys thereof, is probably the most undesirable property limiting their substitution for wood and other less conductive non-metallic structural materials. The effect of this metal characteristic is best seen in windows or doors or other panel assemblies employing metal framing in direct conductive relationship with air at interior and exterior ambient temperatures giving rise to the generation and presence of frost and moisture condensation on the interior surfaces of the framing, especially in climates where extreme temperature differentials prevail. When a panel assembly has a metal outer frame fixed in the rough opening of a wall, and a sash movably mounted in such fixed outer frame with a metal frame peripherally embracing a glass or other panel, the thermal conductivity problem exists with respect to the metal sash frame as well as the metal outer or fixed frame.

A wide variety of solutions to overcome the deleterious high thermal conductivity of metal framing for windows, doors, and similar panel assemblies have been proposed with varying degrees of success. Most of the related art constructions have included some type of thermal break or insultaing barrier installed in an appropriate part of the outer metal frame and also in an appropriate part of the sash frame. Such constructions are often complex and difficult to fabricate as well as being relatively expensive. However, a problem in the related art is that no thermal break or insulating barrier is known that operates to prevent heat conduction between the upper sash and the lower sash or side-by-side panels.

SUMMARY OF THE INVENTION

This invention provides an insulator forming a thermal break between an upper sash and a lower sash of a metal frame window assembly. This invention pertains to a type of window where the lower rail of an upper sash has a channel or flange called an interlock, and similarly a lower sash with an upper rail is also provided with an interlock. These windows are of a design that these two interlocks overlap and a thermal insulator may be placed between the two interlocks to provide a thermal barrier.

This invention is equally applicable to sliding glass doors or horizontal sliding windows where there are in effect side-by-side panels instead of upper and lower sashes.

The related art has placed thermo breaks or barriers within window frame components and within sash components while thermo conduction from sash-to-sash or panel-to-panel has been left uncorrected. The invention is not used internally to a frame or sash piece but rather affixed to the sash surface to be used as a non-thermally conducting junction between two separate window pieces. This invention provides for a simple and inexpensive solution.

DESCRIPTION OF THE PREFERRED EMBODIMENTS

Figure 1:
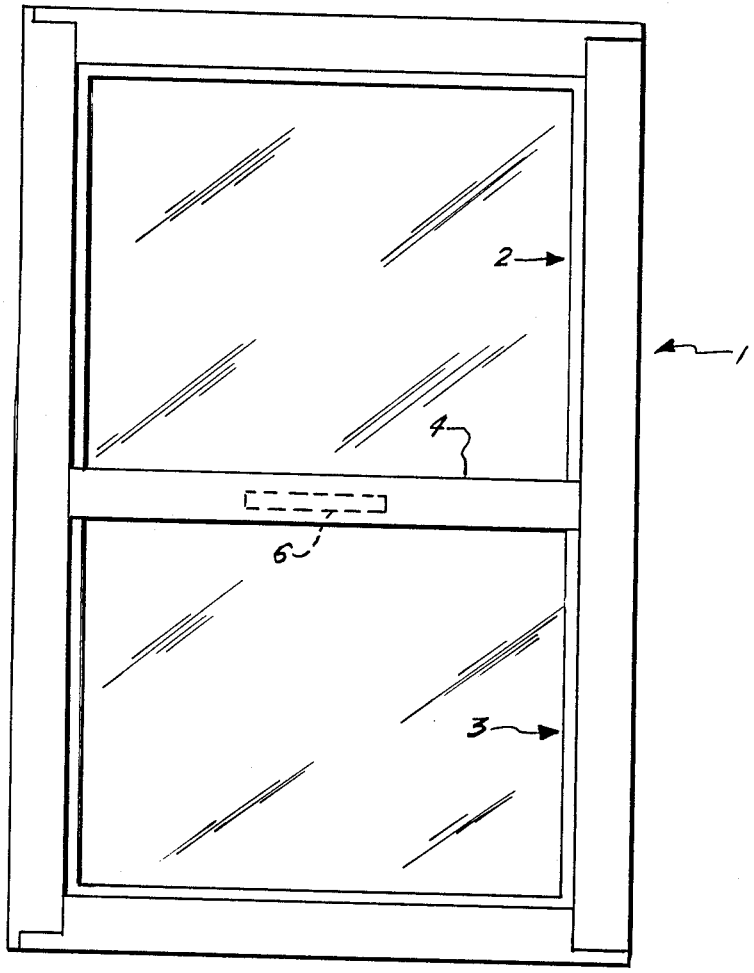
FIG. 1 is a front view of a metal frame window assembly showing upper and lower sashes.
Figure 2:
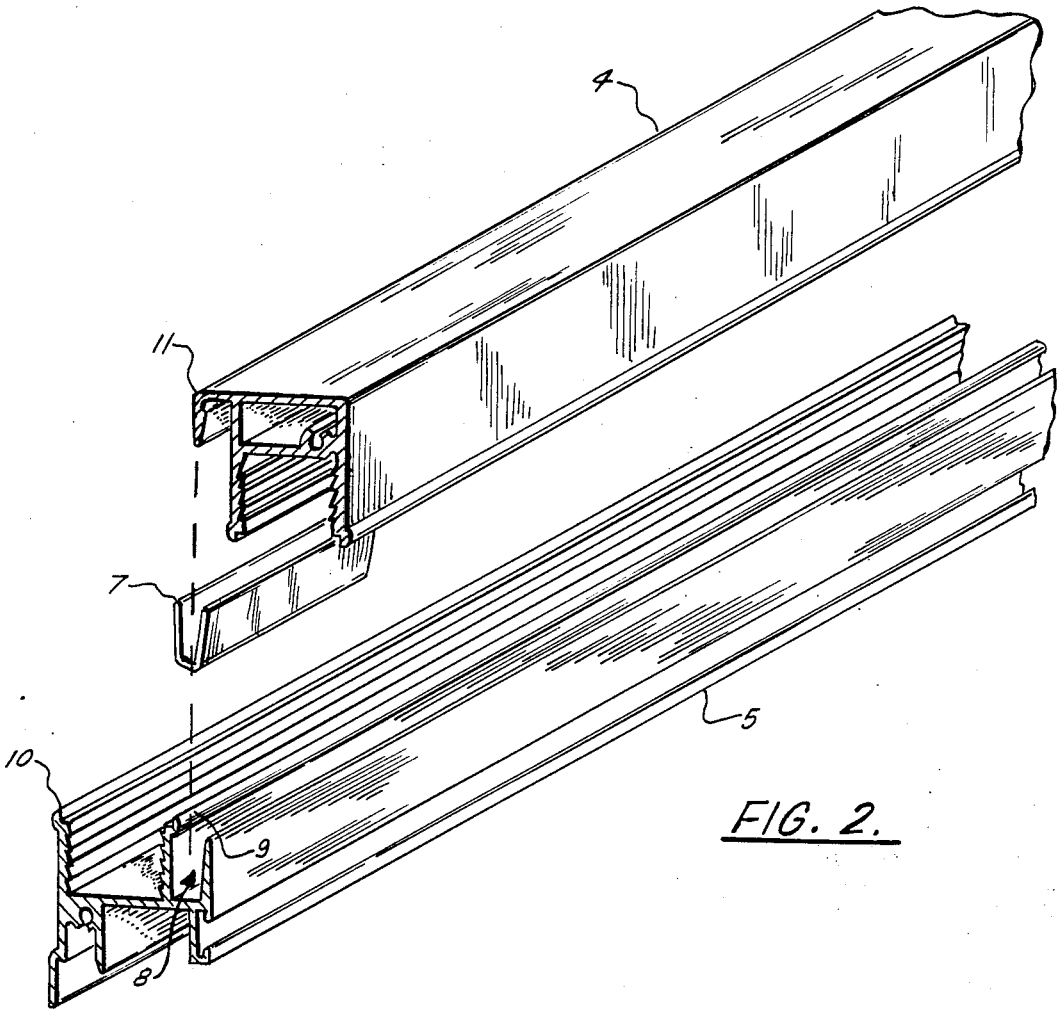
FIG. 2 is a perspective view showing the lower rail of the upper sash, insulator and upper rail of the lower sash as well as related interlocks.
Figure 3:
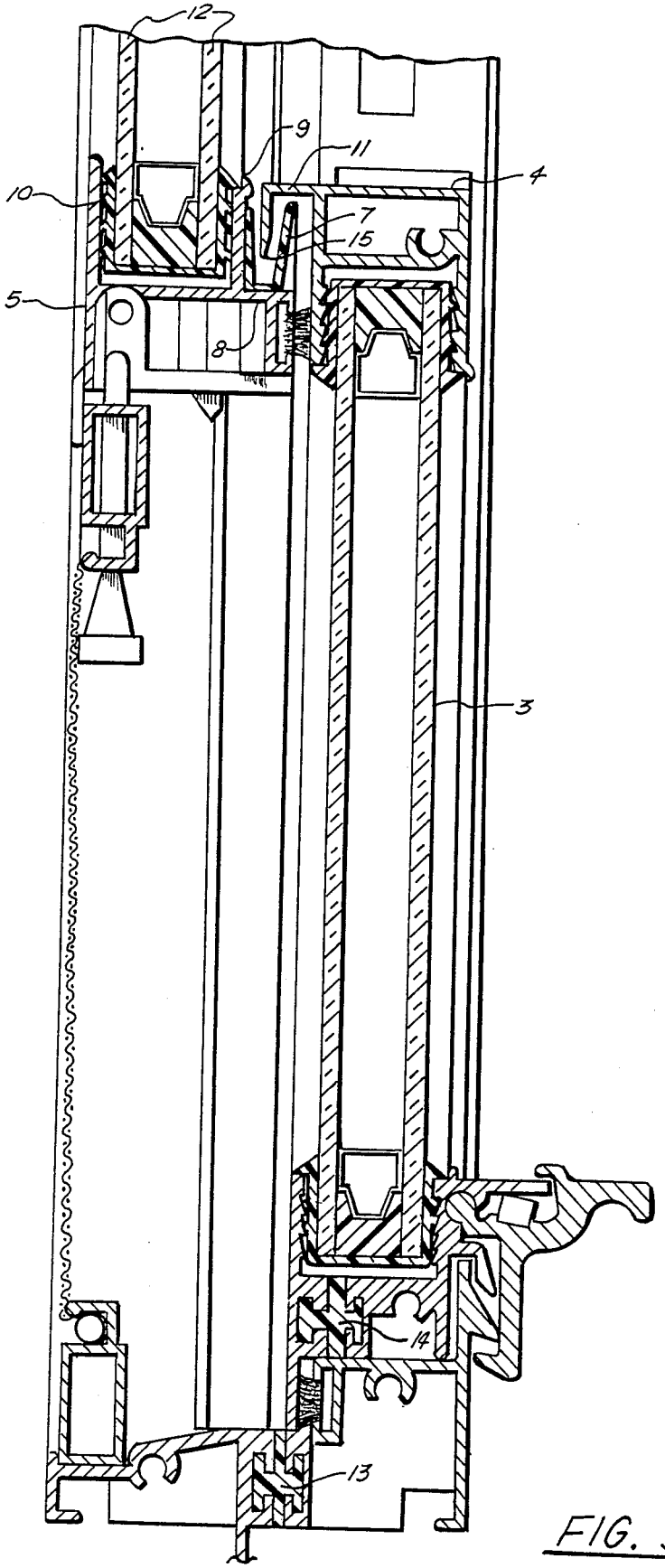
FIG. 3 is a cross-sectional view of the window frame assembly showing the lower sash in its entirety and the cross sections of the interlocks with the insulator in place.

Referring now to FIG. 1 showing in a preferred embodiment a window frame assembly 1 having an upper sash 2 and a lower sash 3. The upper rail of the lower sash is represented by 4. In FIG. 1, the lower rail 5 of the upper sash 2 is hidden but is shown in FIGS. 2 and 3. FIG. 1 provides a general orientation of the inventions location within the window. The insulator of the preferred embodiment may be seen by dashed outline 6. However, it is noted that there is no reason the sashes have to be in an upper and lower orientation. The sashes could be located side-by-side such as in horizontally sliding window or patio doors. Sashes in this orientation are generally referred to as panels.

The invention itself is more clearly viewed in FIG. 2 which is an exploded view of the two aforedescribed rails 4, 5 showing how the insulator 7 is positioned between the two rails 4, 5. More specifically, the lower rail 5 of the upper sash 2 is provided with an interlock 8 which is a channel extending across the length of the rail and outward from the glass panel holding member 9. One or more glass panels 12 will fit between glass panel holding member 9 and glass panel holding member 10. The upper rail 4 of the lower sash 3 is provided with a similar interlock channel 11. The purpose of these interlocks is to give the window strength when exposed to wind loading. The window sashes are given increased structural integrity when the upper sash and the lower sash are in close contact through means of the overlapping interlock portions.

While the drawings show a window assembly having a vertical orientation, the invention is equally applicable if the orientation is rotated to a horizontal position. When viewed in a horizontal position the invention is applicable to a side-by-side door or sliding window assembly. In this orientation the side members of the sash or panel contain the insulator rather than the top/-bottom members as viewed in the drawings. These vertical side members are generally referred to as stiles by the window industry. The specification and claims have been simplified and clarified by simply referring to sashes with rails for doors and sliding windows, as well as vertical windows rather than introducing the term stile separately for sliding windows and doors. Vertical windows cover both single-hung where the upper sash is fixed and double-hung where the upper sash is operable.

The invention is to interpose an insulator 7 between the interlock 8 of the upper sash 2 and interlock 11 of the lower sash 3. A space is located between the tip 15 of interlock 11 and the insulator 7. This will allow interlock 11 to shift to either side of insulator 7 to accommodate lateral in-and-out movement of the sashes 2, 3. Regardless of which side of insulator 7 is contacted by the tip 15 thermal insulation between the interlocks 8 and 11 will be maintained. The preferred embodiment uses an insulator composed of extruded, rigid PVC; however, a number of low-conductive materials could be used such as injection molded nylon. The preferred embodiment is six inches in length, but any number of insulators or lengths could be used. The cross-sectional shape of the insulator is designed to fit snugly within the interlock 8 of lower rail 5 of the upper sash 2. The insulator could be held in place by a mechanical means or suitable plastic-compatible adhesive although the preferred embodiment uses a press or snapon fit. Alternate embodiments could include an insulator along the entire length of the interlock or a plurality of smaller insulators placed within the interlock. Additionally, the insulator could be placed in interlock 11 of the upper rail 4 of the lower sash 3. The preferred thickness of the insulator is within the range of 0.050 and 0.125 inches with the preferred embodiment being 0.062 inches thick.

Thermal breaks of the related art are shown at 13 and 14. These breaks form low-conductive interruptions in the surface of either the frame as with thermal break 13 or the sash with thermal break 14.

Many other variations, modifications, and alternate embodiments may be made in the apparatus and techniques hereinbefore described, by those having experience in this technology, without departing from the concept of the present invention. Accordingly, it should be clearly understood that the apparatus and methods depicted in the accompanying drawings and referred to in the foregoing description are illustrative only and are not intended as limitations on the scope of this invention, as defined in the following claims.

What is claimed is:

1. A metal frame window or door assembly of the type having a rail of a first sash with an interlock and a rail of a second sash with an interlock, the improvement which comprises one of said interlocks carrying a separate insulator means of rigid PVC or injection molded nylon interposed between said interlocks, and said other interlock being dimensioned and configured with respect to said insulator means so as to allow lateral movement between said interlocks.

2. The metal frame window or door assembly of claim 1, wherein said insulator means further comprises a cross-sectional shape which conforms to the cross-sectional shape of the interlock which carries said insulator means.

3. The metal frame window or door assembly of claim 1, wherein said insulator means is affixed to the interlock which carries said insulator means by adhesive.

4. The metal frame window or door assembly of claim 1, wherein said insulator means is affixed to the interlock which carries said insulator means by way of a press fit.

5. The metal frame window or door assembly of claim 1, wherein said insulator means is further comprised of a plurality of separate insulators.

6. The metal frame window or door assembly of claim 1, wherein said insulator means is equal in length to the length of the interlock which carries it.

7. The metal frame window or door assembly of claim 1, wherein said insulator means is of rigid PVC.

8. The metal frame window or door assembly of claim 1, wherein said insulator means is of injection molded nylon.

* * * * *